US012806465B2

(12) United States Patent
Sikora

(10) Patent No.: US 12,806,465 B2
(45) Date of Patent: Nov. 24, 2026

(54) BALANCE AND AGILITY TRAINING DEVICE

(71) Applicant: Ian Lawrence Sikora, Towson, MD (US)

(72) Inventor: Ian Lawrence Sikora, Towson, MD (US)

( * ) Notice: Subject to any disclaimer, the term of this patent is extended or adjusted under 35 U.S.C. 154(b) by 31 days.

(21) Appl. No.: 19/051,284

(22) Filed: Feb. 12, 2025

(65) Prior Publication Data

US 2025/0256151 A1 Aug. 14, 2025

Related U.S. Application Data

(60) Provisional application No. 63/552,629, filed on Feb. 12, 2024.

(51) Int. Cl.
*A63B 22/00* (2006.01)

(52) U.S. Cl.
CPC .. *A63B 22/0046* (2013.01); *A63B 2022/0092* (2013.01); *A63B 2225/093* (2013.01)

(58) Field of Classification Search
CPC ..... A63B 21/4033; A63B 21/4037; A63B 21/4039; A63B 2022/0092
See application file for complete search history.

(56) References Cited

U.S. PATENT DOCUMENTS 5,651,753 A * 7/1997 Wilkinson ..... A63B 23/0458 482/52
5,772,559 A * 6/1998 Sithole ..... A63B 23/0458 482/52
6,648,715 B2 * 11/2003 Wiens ..... A63H 33/062 446/124
7,824,319 B2 * 11/2010 Carlesimo ..... A63B 21/00047 482/141
7,922,624 B1 * 4/2011 Fairhurst ..... A63B 21/0552 482/52
8,052,587 B1 * 11/2011 Wu ..... A63B 23/0458 482/148
8,998,778 B2 * 4/2015 Potts ..... A63B 21/0724 482/106
10,315,064 B2 * 6/2019 Pinkus ..... A63B 23/03541
11,338,165 B2 * 5/2022 Hume ..... A63B 23/1218
12,420,130 B2 * 9/2025 Shelton ..... A63B 21/00047
2007/0161476 A1 * 7/2007 Davies ..... A63B 21/00047 482/148
2007/0219076 A1 * 9/2007 Axelrod ..... A63B 21/00047 482/148
2009/0023563 A1 * 1/2009 Liang ..... A63B 21/072 482/106

(Continued)

*Primary Examiner* — Zachary T Moore

(74) *Attorney, Agent, or Firm* — The Morales Law Firm; Joseph L. Morales

(57) ABSTRACT

An agility training device having a stacking cube for an agility training device and at least one crossbar attached to the stacking cube. The stacking cube has a plurality of sides; a plurality of notches, each notch configured to connect to a crossbar; a plurality of protrusions, each configured to connect to a plurality of recesses on a second stacking cube; and a plurality of recesses configured to connect to a plurality of protrusions on a second stacking cube. The agility training device can be configured to create a varied balance and agility challenges for the user.

14 Claims, 9 Drawing Sheets

(56) References Cited

U.S. PATENT DOCUMENTS

| | | | | |
|---|---|---|---|---|
| 2009/0192028 | A1* | 7/2009 | Shank | A63B 21/00047 482/148 |
| 2009/0247378 | A1* | 10/2009 | Carlesimo | A63B 21/00047 482/141 |
| 2010/0210173 | A1* | 8/2010 | Maggiore | A63H 33/086 446/124 |
| 2012/0329623 | A1* | 12/2012 | Ramirez | A63B 21/00047 482/139 |
| 2013/0274078 | A1* | 10/2013 | Andrews | A63B 23/1236 482/141 |
| 2018/0256940 | A1* | 9/2018 | Lyons | A63B 26/003 |
| 2024/0058642 | A1* | 2/2024 | Flynn | A63B 21/4037 |
| 2024/0082626 | A1* | 3/2024 | Kocott | A63B 23/0458 |
| 2025/0135265 | A1* | 5/2025 | Daily | A63B 21/4037 |
| 2025/0256145 | A1* | 8/2025 | Westmoreland | A63B 21/00047 |

* cited by examiner

BALANCE AND AGILITY TRAINING DEVICE

CROSS-REFERENCE TO RELATED APPLICATIONS

This application claims priority from U.S. Provisional Application No. 63/552,629 filed on Feb. 12, 2024, entitled BALANCE AND AGILITY TRAINING DEVICE, which is incorporated herein by reference in their entirety.

FIELD OF THE INVENTION present invention relates to the assessment and training of balance, agility, safety, and fitness.

BACKGROUND

The Four-Square Step Test (FSST) is a validated assessment tool for determining fall risk in many patient populations. It is commonly performed as part of balance evaluations in hospitals, home care, and outpatient physical therapy clinics.

The FSST requires patients to step (forward, backward, and laterally) over a cross, which is typically comprised of 4 pipes, each being 1" in diameter and 39" long. In clinical practice, these dimensions are often altered for convenience. For example, it is customary for the test to be performed with four canes arranged on the floor in a cross pattern.

It is also common practice to perform variations on the FSST sequence involving diagonal stepping, repeated lateral steps, etc. For this reason, the invention discussed below will refer to a more general type of balance and agility task: Quadrant Training (QT).

There exist methods for making QT more complex and, therefore, developing advanced balance skills in appropriate patients through the elevation of the cross; these products, however, support the cross at its terminal ends. Changing the height of the task, therefore, requires four separate adjustments. If training is desired at four unique heights, the user may need up to sixteen supports.

In addition, there are no devices that allow for QT to be performed at two different heights simultaneously. As many people can perform lateral stepping tasks more easily than anterior/posterior stepping tasks, this limitation restricts the progression of appropriate activity participants. In one hypothetical example, a patient safely performing the lateral stepping aspect of QT at the height of 6 inches may only be safe with stepping forward and backward over an obstacle 3 inches from the floor. With the currently available products, this person is limited to practicing the entire task at the most restrictive height (in this case, 3 inches).

SUMMARY OF THE INVENTION

The present invention seeks to provide a solution to this problem by providing a novel, modular cradle system that supports both crosses and straight pieces at a variety of heights—not from the extremities, but from the center—allowing for testing and training of balance and agility at a variety of heights (sometimes simultaneously) without the need for excess equipment.

In one embodiment, a stacking cube for an agility training device has a plurality of sides; a plurality of notches, each notch configured to connect to a crossbar; a plurality of protrusions, each configured to connect to a plurality of recesses on a second stacking cube; and a plurality of recesses configured to connect to a plurality of protrusions on a second stacking cube.

In another embodiment, an agility training device includes a stacking cube for an agility training device and at least one crossbar. The stacking cube has a plurality of sides; a plurality of notches, each notch configured to connect to a crossbar; a plurality of protrusions, each configured to connect to a plurality of recesses on a second stacking cube; and a plurality of recesses configured to connect to a plurality of protrusions on a second stacking cube.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
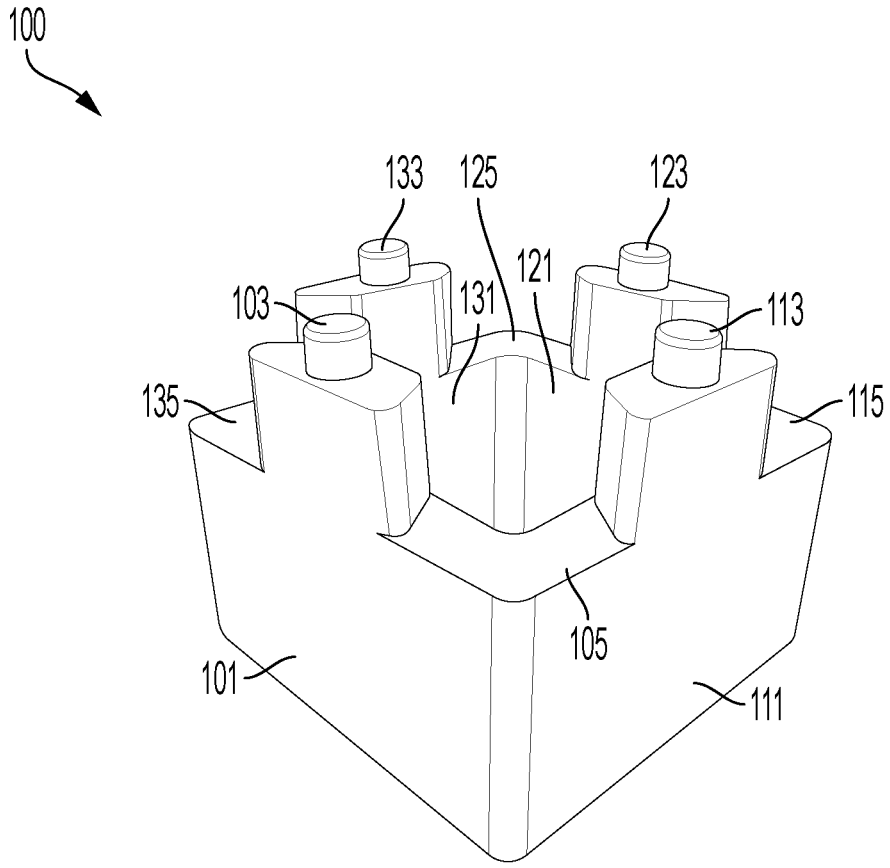
FIG. 1 shows a perspective view of a stacking cube.

In an exemplary embodiment, FIG. 1 shows a stacking cube (100) of a balance and agility training device (400) that has a plurality of sides. The stacking cube (100), in some embodiments, has four sides: a first side (101), a second side (111), a third side (121) and a fourth side (131). In some embodiments, the plurality of sides have an equal width. In other embodiments, the first side (101) and the third side (121) have the a first width, and the second side (111) and the fourth side (131) have a second width. In some embodiments, the sides form a cube in which the sides at the top of the staking cube (100) form a top polygon, e.g., a square and a bottom polygon, e.g., square, where the top polygon, e.g., square, has a perimeter that is equal to a perimeter of the bottom polygon, e.g., square, of the stacking cube (100) and results in sides that are perpendicular to the plane of the base of the stacking cube (100). In some embodiments, the top polygon, e.g., square, and the bottom polygon, e.g., square, have different perimeters. In other embodiments, the sides form a cube in which the sides at the top of the staking cube (100) form a polygon, e.g., square, that is smaller than the polygon, e.g., square, at the bottom of the stacking cube (100) resulting in sides that are not perpendicular to the plane of the base of the stacking cube (100). In some embodiments, the stacking cube (100) may have more or less than four sides.

Figure 2:
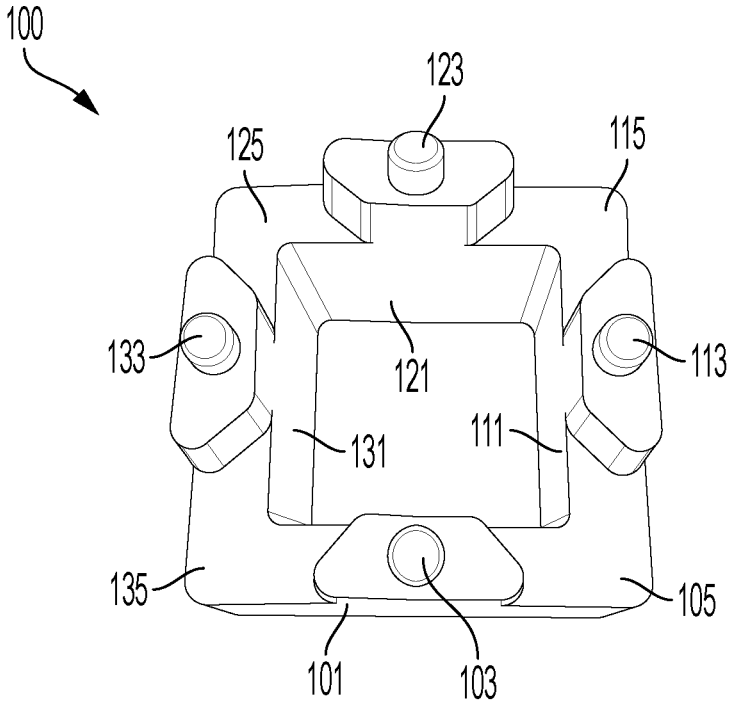
FIG. 2 shows a top view of a stacking cube.

As shown in FIG. 2, the stacking cube (100) has a plurality (two or more) of notches that allow a QT tube to be attached to the stacking cube (100). In some embodiments, the stacking cube has a first notch (105), a second notch (115), a third notch (125), and a furth notch (135). The notches have height and width that is equal to or greater than the diameter of the tubing chosen for QT as described below. The width and height are designed to allow the tubing to sit within the notches.

The stacking cube (100), in some embodiments, has a plurality (two or more) of protrusions. In one exemplary embodiment, the stacking cube (100) has a first protrusion (103), a second protrusion (113), a third protrusion (123), and a fourth protrusion (133). The protrusions are designed to secure a first stacking cube (100) to a second stacking cube (100). In some embodiments that protrusions may be cylindrical, while in other embodiments, the protrusions may have any geometric shape that matches a recess in an adjacent stacking cube (100) to which a stacking cube (100) can be secured.

Figure 3:
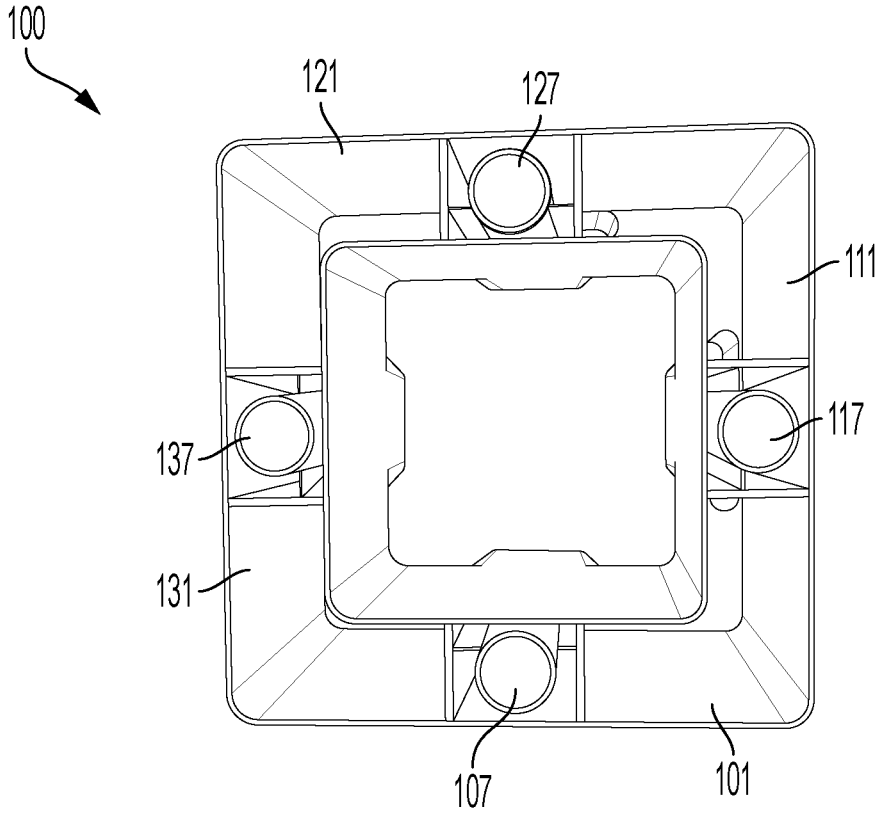
FIG. 3 shows a bottom view of a stacking cube.

As shown in FIG. 3, the bottom side of the stacking cube (100) has a plurality of recesses configured to couple with the protrusions of a second stacking cube (100). In one exemplary embodiment, a first recess (127) is configured to couple with the first protrusion (103), the second recess (117) is configured to couple with the second protrusion (113), the third recess (107) is configured to couple with the third protrusion (123), the fourth recess (137) is configured to couple with the fourth protrusion (133). When stacked, the protrusions on a lower stacking cube (100) couple with the holes in an upper stacking cube (100), allowing for secure stacking of cubes. Some embodiments comprise more or less than four protrusions and recesses in the stacking cube (100). In some embodiments, other means for coupling the upper stacking cube (100) with a lower stacking cube (100) may be utilized.

Figure 4A:
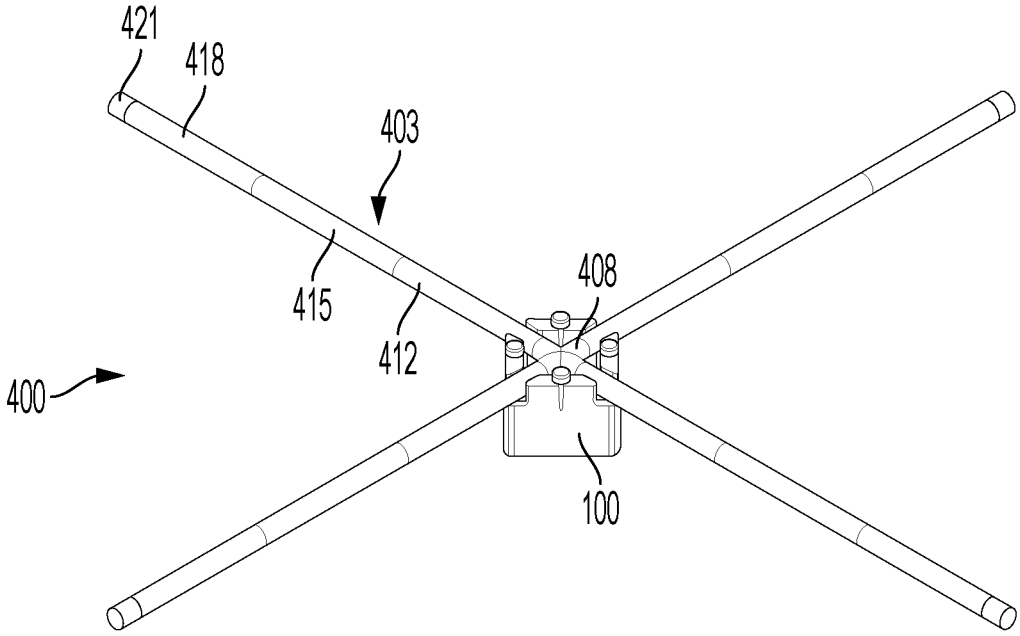
FIG. 4A shows a perspective view of a balance and agility training device having a QT cross.
Figure 4B:
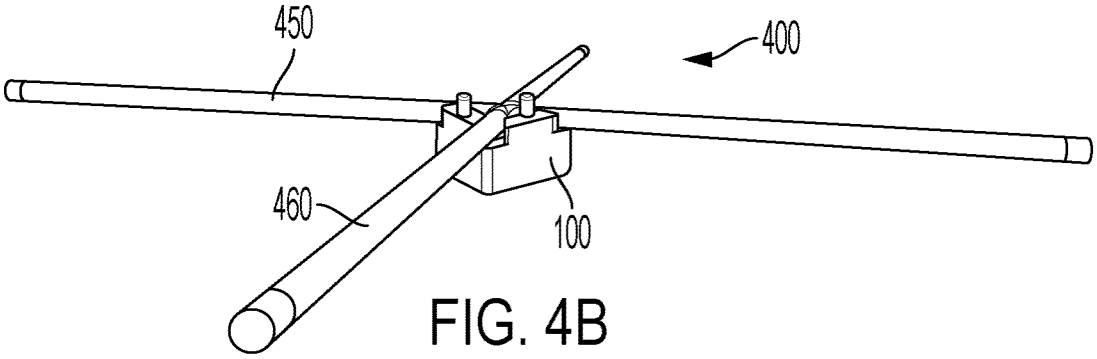
FIG. 4B shows a perspective view of a balance and agility training device having a segmented QT cross.

One exemplary embodiment of an assembled balance and agility training device (400) is shown on FIG. 4A. The shown exemplary embodiment of the agility training device (400) has a stacking cube (100) and an exercise cross (403). As shown in FIG. 4B, the exercise cross (403) comprises a plurality of sections and a joint (408). In one embodiment, the exercise cross (403) comprises a first crossbar (450) and a second crossbar (460). In one embodiment, the exercise cross (403), each crossbar comprises a near section (412), an intermediate section (415) and a far section (418). In one exemplary embodiment, the joint (408) can accept at least two near sections (412). The joint (408) is configured so that the intermediate sections (412) are oriented so that they fit in the notches of the stacking cube (100). Multiple intermediate sections (415) consecutively connected to extend the length of the exercise cross (403) are utilized in some embodiments. The far section (418) is connected to the last intermediate section (415) and, in some embodiments, may include a cap (421). It is also contemplated that, in some embodiments, the exercise cross does not include any intermediate sections (415) and that the far section (418) connects with the near section (412).

In some exemplary embodiments of the agility training device (400), only near sections (412) are connected to the joint (408). In yet further embodiments, only two near sections (412) are attached to the joint (408). The near sections (412) may be on opposite ends of the joint (408) or perpendicular to each other.

Figure 4C:
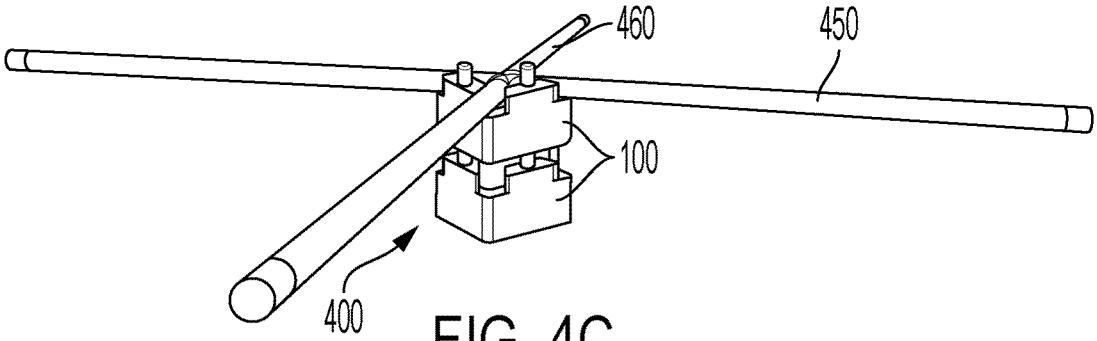
FIG. 4C shows a perspective view of a balance and agility training device having a QT cross on two stacking cubes.
Figure 4D:
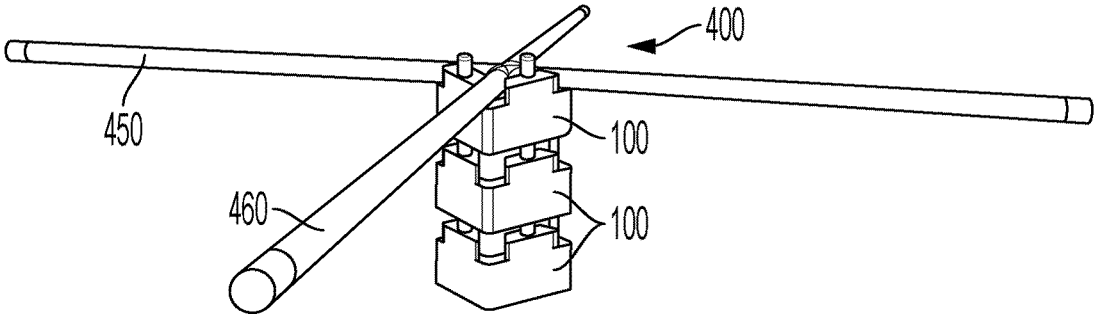
FIG. 4D shows a perspective view of a balance and agility training device having a QT cross on three stacking cubes.
Figure 4E:
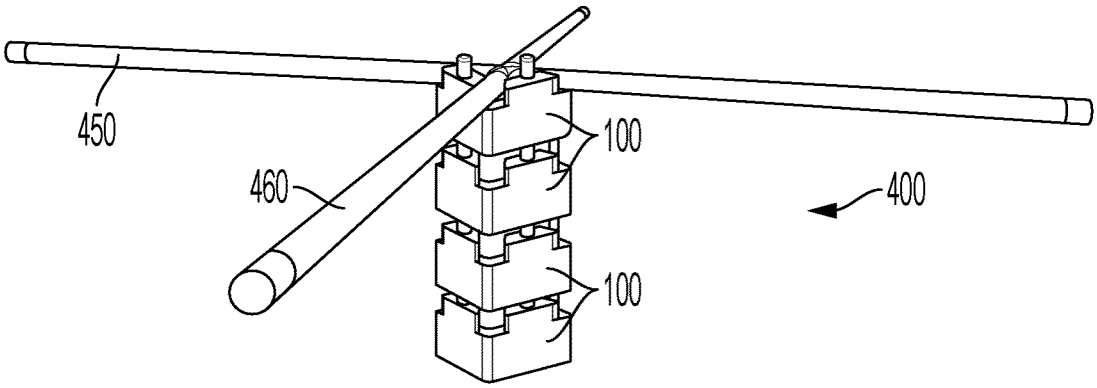
FIG. 4E shows a perspective view of a balance and agility training device having a QT cross on four stacking cubes.

When one staking cube (100) is placed on the QT surface (or when cubes are stacked), the exercise cross (403) can be placed in the notches of the uppermost cube, allowing QT to be performed at a prescribed distance from the floor. In some embodiments, the distance from the floor is multiple of the stacking cube (100) height. As shown on FIG. 4C, when two stacking cubes (100) are used, the distance from the floor is the sum of the two cube's heights. FIG. 4D shows three stacking cubes (100) and FIG. 4E shows four stacking cubes (100). In some embodiments, the height of the cube can be between 2 inches and 4 inches, in others the height is between 2.5 inches and 3.5 inches, in yet some other embodiments the height of the stacking cube is 3 inches. In some embodiments, the stacking cubes (100) have a width of between 3 inches and 5 inches, in other embodiments the width is between 3.5 inches and 4.5 inches, in yet a further embodiment the width of the stacking cube is 4 inches.

Figure 5:
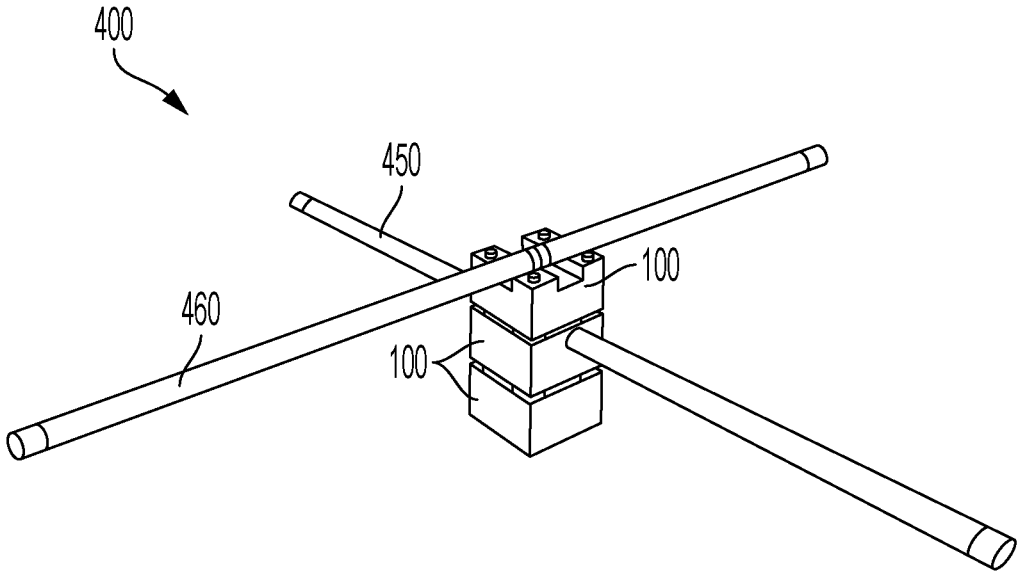
FIG. 5 shows a perspective view of a balance and agility training device simultaneously supporting straight pieces at two separate heights on three stacking cubes.

When more than one stacking cube (100) is utilized, as shown in FIG. 5, each stacking cube (100) can support a crossbar oriented perpendicular to one another, allowing for simultaneous QT at two different heights. One stacking cube (100) supports a first crossbar (450) while a second stacking cube (100) supports a second crossbar (460).

Figure 6:
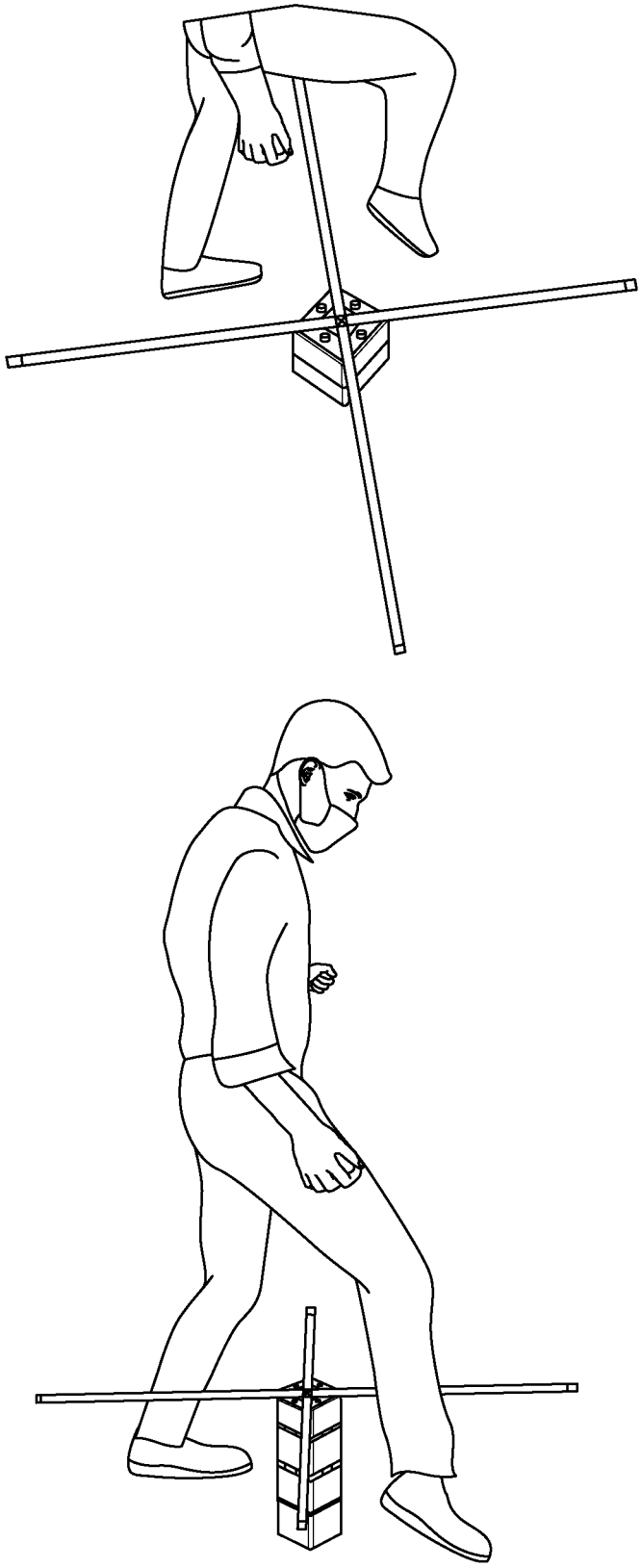
FIG. 6 shows the balance and agility training device with a user stepping forward, backward, and diagonally.
Figure 7:
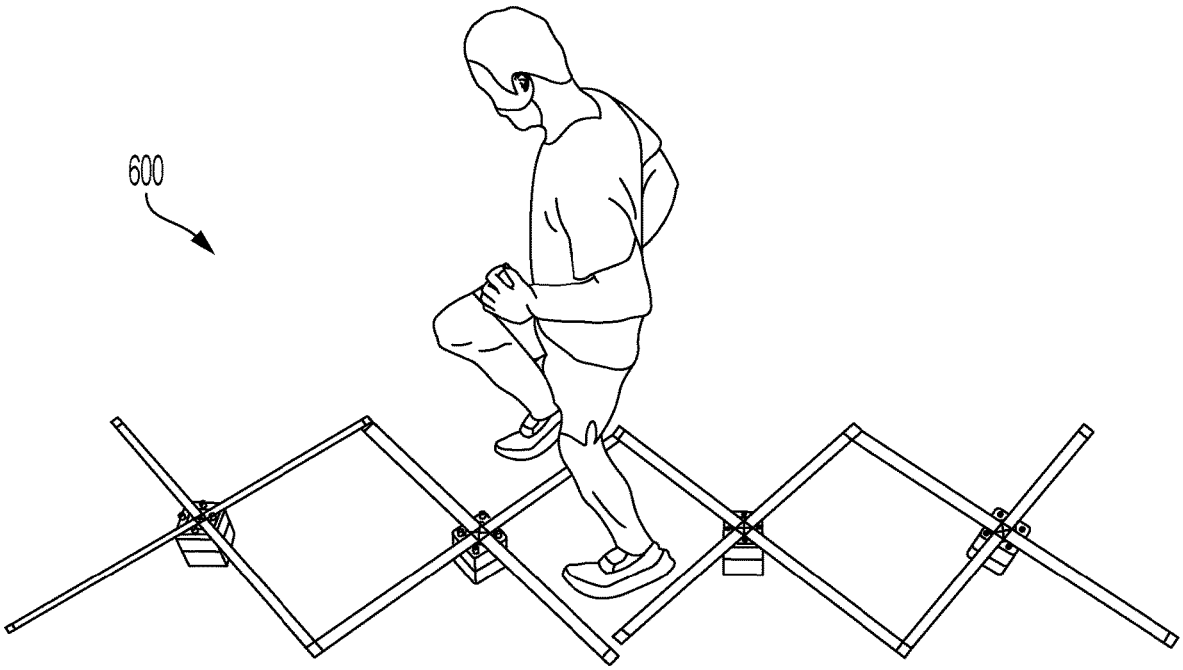
FIG. 7 shows a balance and agility training device with a user performing an agility drill.

The agility training device (400) is used in a method of improving agility as shown in FIG. 6. A single stacking cube (100) supports an exercise cross (403). The patient can work on drills around the four arms of the exercise cross at a prescribed height. The patient may step over each section, diagonally, backwards, and in any combination that allows for appropriate exercise of coordination. FIG. 6 also shows a patient utilizing a stack of four stacking cubes (100) and a single exercise cross (403).

In one further embodiment of the invention, the agility training device (400) can be deployed as a system (600). A plurality of stacking cubes (100) can be placed in a row and the exercise crosses (403) or each agility training device (400) are placed such that a crossbar (450) of one agility training device connects with the end of the crossbar (450) of a second agility training device (400). The resulting configuration creates an exercise field with multiple bars for the patient to utilize. Multiple exercise crosses (403) and stacking cubes (100) can be combined to create a varied balance and agility challenge. In some combinations, the exercise crosses (403) and stacking cubes (100) can mimic commonly performed agility exercises such as ladder drills and tire drills.

Figure 8:
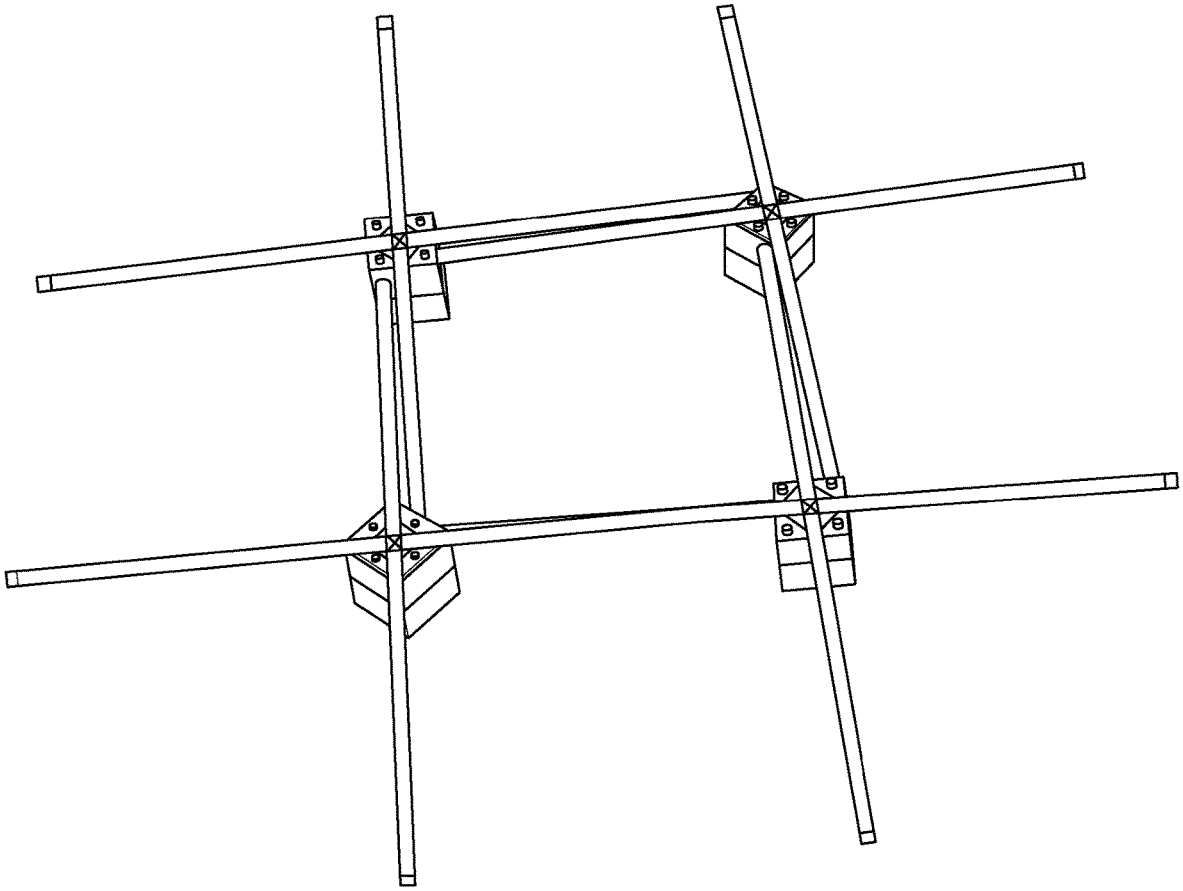
FIG. 8 shows a balance and agility training device having eight stacking cubes (four groups of two with each stack supporting a QT cross) arranged in a manner to expand the footprint of QT.

In yet a further embodiment, the system (600), as shown in FIG. 8, a first crossbar (450) connects with two stacking cubes (100) placed a sufficient distance apart so that the crossbar (450) is supported by two stacking cubes (100). A further version of the system (600) results in a polygon, e.g., square, where the stacking cubes (100) form the corners and first crossbars (450) and second crossbars (460) form a grid.

What is claimed is:

1. A stacking cuboid for an agility training device, comprising:

a plurality of sides;

a plurality of notches, the plurality of notches are configured to form a plurality of passages for a crossbar that extends beyond an outer perimeter of said cuboid, wherein the plurality of passages are open vertically away from the plurality of sides and allow the crossbar to be removed vertically;

a plurality of protrusions, each configured to connect to a plurality of recesses on a second stacking cube; and a plurality of recesses configured to connect to a plurality of protrusions on a second stacking cube.

2. The stacking cuboid of claim 1, wherein the plurality of sides include a first side, a second side, a third side, and a fourth side.

3. The stacking cuboid of claim 1, wherein the plurality of sides have an equal width.

4. The stacking cuboid of claim 1, wherein the plurality of sides have an equal height.

5. The stacking cuboid of claim 1, wherein the plurality of sides form a top polygon and a bottom square of having an equal perimeter.

6. The stacking cuboid of claim 1, wherein the plurality of sides form a top square and a bottom polygon of having a different perimeter.

7. The stacking cuboid of claim 1, wherein the plurality of sides are perpendicular to a plane of a bottom of the stacking cube.

8. The stacking cuboid of claim 1, wherein the plurality of sides are not perpendicular to a plane of a bottom of the stacking cube.

9. The stacking cuboid of claim 1, wherein the notches have a height and a width that is equal or greater than the diameter of the crossbar.

10. An agility training device, comprising:

a stacking cuboid for the agility training device, comprising:

a plurality of sides;

a plurality of notches, the plurality of notches are configured to form a plurality of passages for a crossbar that extends beyond an outer perimeter of said cuboid, wherein the plurality of passages are open vertically away from the plurality of sides and allow the crossbar to be removed vertically;

a plurality of protrusions, each configured to connect to a plurality of recesses on a second stacking cuboid; and a plurality of recesses configured to connect to a plurality of protrusions on a second stacking cuboid; and at least one crossbar attached to the stacking cuboid.

11. The agility training device of claim 10, further comprising one or more additional stacking cuboids connected to one or more crossbars.

12. The agility device of claim 10, wherein the stacking cuboid is attached to one or more second stacking cuboids to change the height of the crossbar.

13. The agility device of claim 10, wherein a first stacking cuboid is attached to and supports a first crossbar of the at least one crossbar; said first stacking cube is attached to a second stacking cube and a second crossbar is attached to said second stacking cube; wherein the first crossbar is higher than and perpendicular to the second crossbar.

14. The agility device of claim 10, comprising a plurality of stacking cuboids and a plurality of crossbars, arranged in a ladder configuration, a diamond configuration, or a square configuration.

* * * * *